US010441095B2

(12) United States Patent
Krake et al.

(10) Patent No.: US 10,441,095 B2
(45) Date of Patent: Oct. 15, 2019

(54) BRACKET FOR USE WITH WALL OBJECTS

(71) Applicant: UNDER THE ROOF DECORATING INC., Calgary (CA)

(72) Inventors: Kelly R. Krake, Calgary (CA); Liette Tousignant, Calgary (CA); Michael Kurtz, Calgary (CA); Ian Matthew Campana, Calgary (CA)

(73) Assignee: UNDER THE ROOF DECORATING INC., Calgary (CA)

( * ) Notice: Subject to any disclaimer, the term of this patent is extended or adjusted under 35 U.S.C. 154(b) by 0 days.

(21) Appl. No.: 15/846,889

(22) Filed: Dec. 19, 2017

(65) Prior Publication Data

US 2019/0008292 A1 Jan. 10, 2019

Related U.S. Application Data

(63) Continuation-in-part of application No. 29/609,954, filed on Jul. 7, 2017.

(51) Int. Cl.

| | |
|---|---|
| ***A47G 1/00*** | (2006.01) |
| ***A47G 1/16*** | (2006.01) |
| ***A47G 1/22*** | (2006.01) |

(52) U.S. Cl.

CPC ..... *A47G 1/1606* (2013.01); *A47G 1/22* (2013.01)

(58) Field of Classification Search

CPC ..... A47G 1/1606; A47G 1/20; A47G 1/205; A47G 1/16

USPC ..... 248/475.1, 476, 477, 478; 40/155, 156

See application file for complete search history.

(56) References Cited

U.S. PATENT DOCUMENTS

| | | | | |
|---|---|---|---|---|
| 4,216,597 | A | 8/1980 | Kocina et al. | |
| 4,348,826 | A * | 9/1982 | Reim | A47G 1/10 40/782 |
| 5,189,820 | A * | 3/1993 | Komamura | A47G 1/0611 16/355 |
| 5,265,358 | A * | 11/1993 | Borod | A47G 1/10 40/758 |
| 10,098,483 | B2 * | 10/2018 | Krake | A47G 1/1633 |
| 2007/0187566 | A1 * | 8/2007 | Price | A47G 1/1613 248/477 |
| 2007/0210234 | A1 * | 9/2007 | Lin | A47G 1/162 248/475.1 |
| 2008/0098664 | A1 * | 5/2008 | McGregor | A47B 95/04 52/38 |

* cited by examiner

*Primary Examiner* — Steven M Marsh

(74) *Attorney, Agent, or Firm* — Norton Rose Fulbright Canada LLP; Alexandre Daoust

(57) ABSTRACT

A bracket is engageable with an object to position the object relative to a support structure. The bracket has a body having at least one peripheral wall defining a wall surface. The body has a flange extending outwardly from the wall surface of the at least one peripheral wall and has an outer surface and an opposed inner surface. The flange is insertable into a channel of the object to engage the bracket with the object. The flange has at least one resilient member extending away from at least one of the inner and outer surfaces of the flange. The at least one resilient member is resiliently displaceable toward said surface of the flange upon the flange being inserted into the channel to abut the at least one resilient member against a surface of the channel. The bracket also has a position element extending outwardly from the body.

15 Claims, 9 Drawing Sheets

BRACKET FOR USE WITH WALL OBJECTS

CROSS-REFERENCE TO RELATED APPLICATIONS

This application claims priority to U.S. patent application Ser. No. 29/609,954 filed Jul. 7, 2017, the entire contents of which are hereby incorporated by reference.

TECHNICAL FIELD

The application relates generally to hanging objects such as picture frames, mirrors, etc. onto a supporting wall or structure, and, more particularly, to a bracket for use with such wall objects.

BACKGROUND OF THE ART

There are a few options available to hang wall objects on walls. One option is to hang a frame of the wall object on one or more exposed nails secured in the wall. This does not secure the wall object to the wall, and the wall object may therefore fall off the wall if bumped. Another option requires the installation of additional hardware on the frame of the wall object. The hardware could be picture wire, D-ring hangers, a sawtooth hanger, etc. This hardware will keep the wall object on the wall more securely but prevents the frame from being flush against the wall. Also, such hanging hardware is difficult to install accurately on the frame and accurate placement on the wall is difficult.

SUMMARY

In one aspect, there is provided a bracket engageable with an object to position the object relative to a support structure, the object having a mating surface and a channel extending into the mating surface, the bracket comprising: a body having at least one peripheral wall defining a wall surface, the wall surface facing the mating surface upon the bracket engaging the object, the body having a flange extending outwardly from the wall surface of the at least one peripheral wall and having an outer surface and an opposed inner surface, the flange being insertable into the channel of the object to engage the bracket with the object, the flange having at least one resilient member extending away from at least one of the inner and outer surfaces of the flange, the at least one resilient member being resiliently displaceable toward said surface of the flange upon the flange being inserted into the channel to abut the at least one resilient member against a surface of the channel; and a position element extending outwardly from the body.

In another aspect, there is provided a combination of a frame and a bracket to position the frame relative to a support structure: the frame having an inner surface with a channel extending into the inner surface; and the bracket comprising: a body having at least one peripheral wall defining a wall surface, the wall surface facing the inner surface upon the bracket engaging the frame, the body having a flange extending outwardly from the wall surface of the at least one peripheral wall and having an outer surface and an opposed inner surface, the flange being insertable into the channel of the frame to engage the bracket with the frame, the flange having at least one resilient member extending away from at least one of the inner and outer surfaces of the flange, the at least one resilient member being resiliently displaceable toward said surface of the flange upon the flange being inserted into the channel to abut the at least one resilient member against a surface of the channel; and a position element extending outwardly from the body.

In a further aspect, there is provided a method of installing a bracket on an object, comprising: inserting a flange of the bracket into a channel of the object, the flange having at least one resilient member being resiliently displaceable relative to the flange, the at least one resilient member abutting against a surface of the channel upon the flange being inserted into the channel.

DESCRIPTION OF THE DRAWINGS

Reference is now made to the accompanying figures in which:

FIG. 1D is a side elevational view of the bracket of FIG. 1A;

DETAILED DESCRIPTION

Figure 1A:
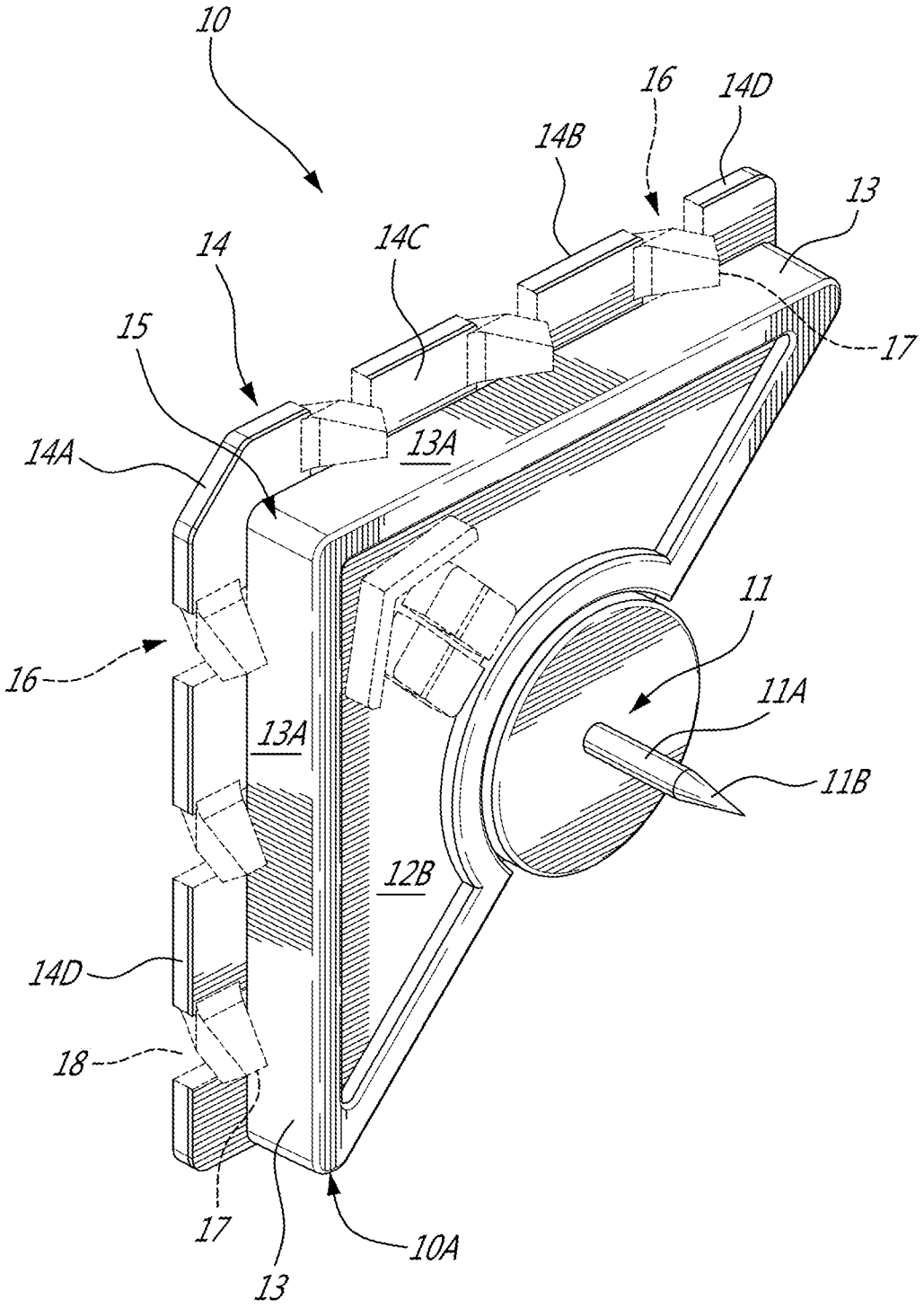
FIG. 1A is a perspective view of a bracket, according to an embodiment of the present disclosure.
Figure 1B:
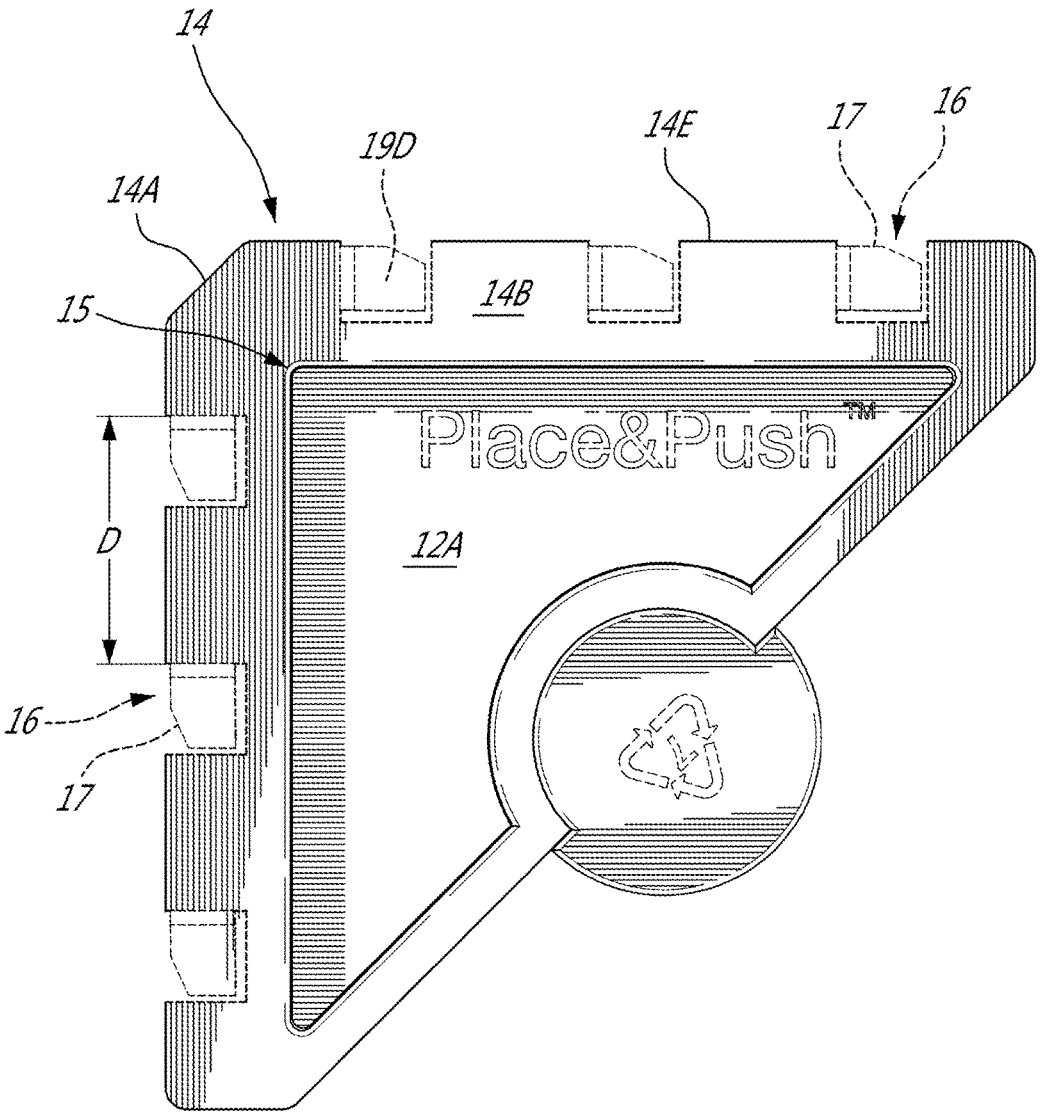
FIG. 1B is a bottom view of the bracket of FIG. 1A.
Figure 1C:
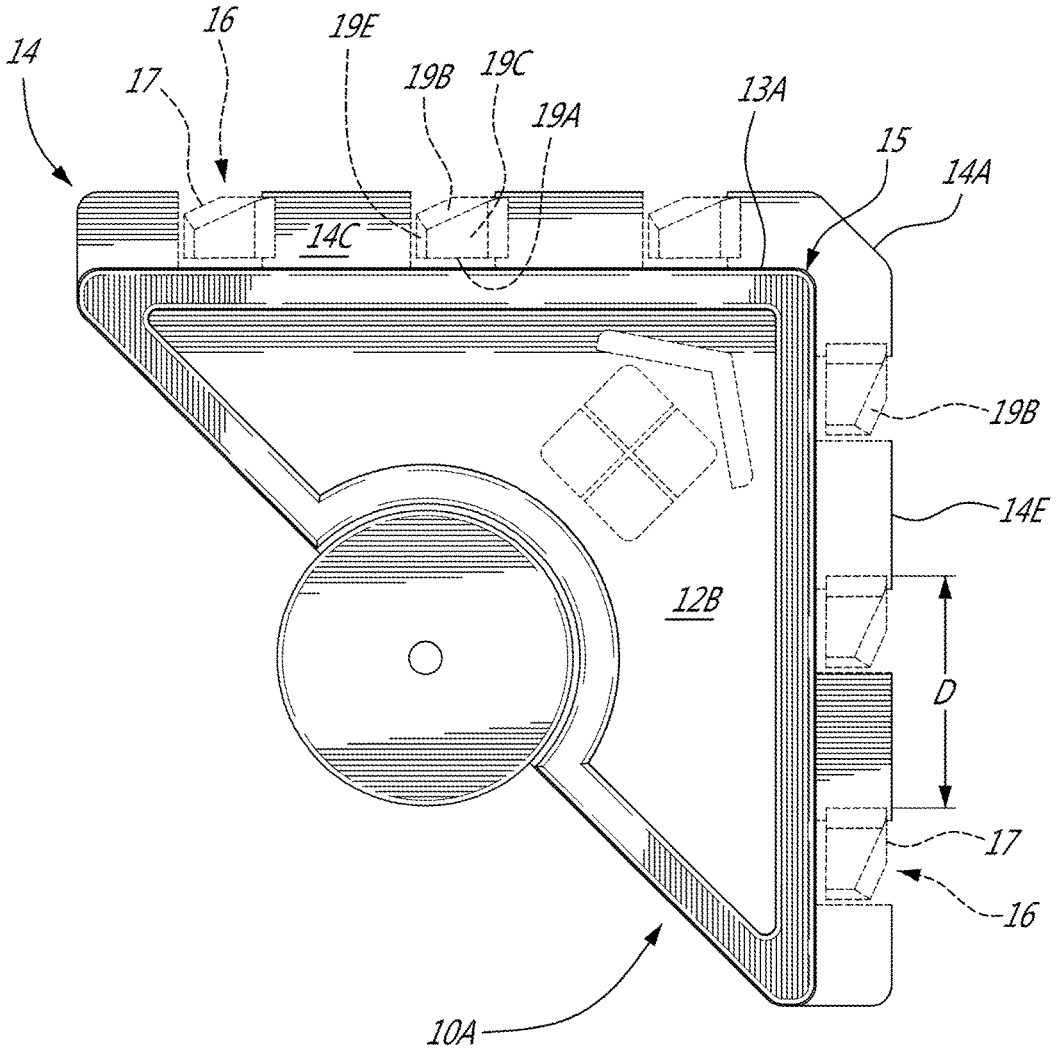
FIG. 1C is a top view of the bracket of FIG. 1A.
Figure 10:
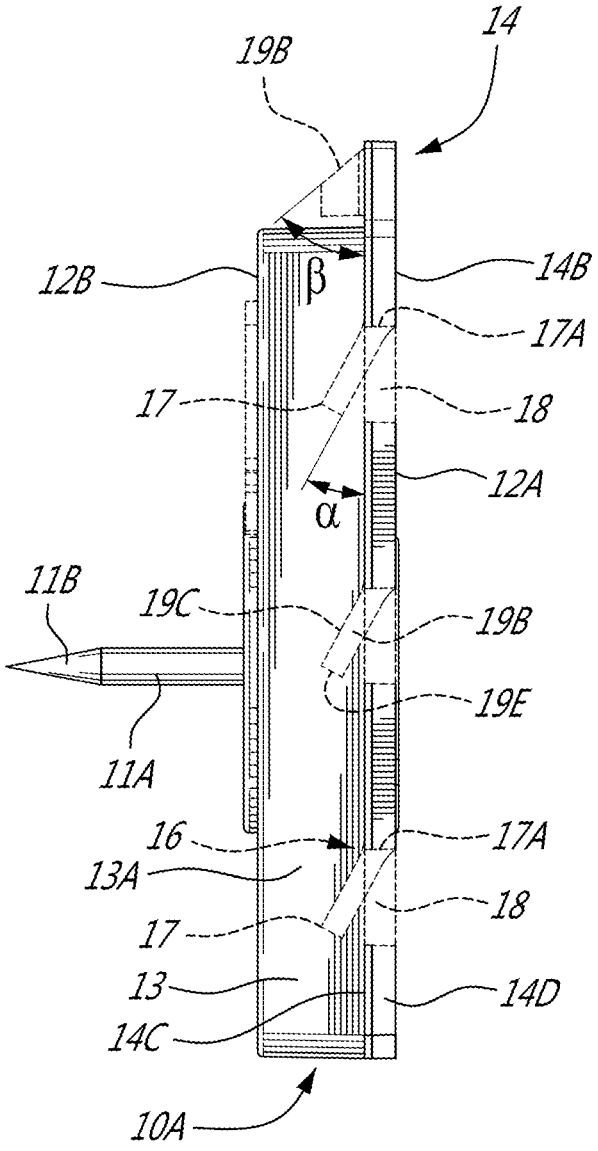

FIGS. 1A to 1D illustrate a bracket 10. The bracket 10 of the depicted embodiment is used to removably attach an object to a support structure, such as a wall, so as to hang the object onto the support structure. The bracket 10 has a position element 11 which, in the depicted embodiment, includes an attachment pin 11A with a sharp, pointed end 11B for mounting the object to the wall. The bracket 10 disclosed herein can be used for other purposes as well. For example, in an alternate embodiment, the position element 11 of the bracket 10 includes a marking device with a marking element used to mark the position of the object, such as a frame, with respect to a support structure, such as a wall. The bracket 10 in the depicted embodiment is a one-piece member formed of a molded plastic material. Alternatively, the bracket 10 may be formed from multiple pieces for shipping convenience. Still further, the bracket 10 may be manufactured from a variety of materials other than plastic.

The bracket 10 includes a body 10A which includes first and second opposed surfaces hereinafter referred to as an inner surface 12A and an outer surface 12B. The body 10A has a thickness between the inner and outer surfaces 12A, 12B, the thickness being defined by one or more peripheral walls 13 extending between the inner and outer surfaces 12A, 12B. Each peripheral wall 13 is a wall along a periphery of the body 10A and defines an outer bound thereof. In the depicted embodiment, the body 10A has two peripheral walls 13 which intersect at a right angle to one another, forming a right-angled corner bracket 10. In an alternate embodiment, the body 10A has only one peripheral wall 13. A body 10A with more than two peripheral walls 13 is also within the scope of the present disclosure. Each wall 13 has a wall surface 13A. The wall surfaces 13A are straight planar surfaces in the bracket 10 of FIGS. 1A to 1D. In alternate embodiments, the wall surfaces 13A are curved surfaces. In the depicted embodiment, the body 10A has a triangular shape. The body 10A may have other shapes as well. Alternate shapes for the body 10A are described in greater detail below.

The body 10A has a flange 14. The flange 14 is inserted into a channel or groove of the object to be positioned with respect to the support structure, and the flange 14 is removable from the channel. The flange 14 is an elongated projection extending outwardly from the wall surfaces 13A of the walls 13. The flange 14 extends at a right angle to the wall surfaces 13A. In an alternate embodiment, the flange 14 extends outwardly from the wall surface 13A at a non-normal angle to the plane of the wall surface 13A. In the depicted embodiment, the flange 14 extends along all of the length of the walls 13. In an alternate embodiment, the flange 14 extends along only part of the length of the walls 13. In the depicted embodiment, the flange 14 extends from the wall surfaces 13A of both peripheral walls 13 and forms a right angle at a corner 15 of the body 10A. The flange 14 has a chamfered edge 14A adjacent to the corner 15 of the body 10A. The flange 14 extends outwardly from the wall surface 13A adjacent to the inner surface 12A of the body 10A. In an alternate embodiment, the flange 14 extends outwardly from the wall surface 13A along a portion thereof between the inner and outer surfaces 12A, 12B of the body 10A, or adjacent to the outer surface 12B. It will therefore be appreciated that the flange 14 in the depicted embodiment is a peripheral flange 14 extending outwardly from the body 10A of the bracket 10 along at least one side thereof.

Still referring to FIGS. 1A to 1D, the projection that forms the flange 14 is a three-sided object with an inner surface 14B, an opposite outer surface 14C, and an intermediate surface 14D extending between and interconnecting the inner and outer surfaces 14B, 14C. The intermediate surface 14D forms a right-angle with the inner and outer surfaces 14B, 14C. In an alternate embodiment, the intermediate surface 14D is a bevelled surface or edge. In yet another alternate embodiment, there is no intermediate surface 14D. In such an embodiment, the flange 14 has only the inner and outer surfaces 14B, 14C, which meet along a common edge.

Still referring to FIGS. 1A to 1D, the flange 14 has one or more one resilient members 16. The resilient members 16 are inserted into the channel of the object along with the flange 14 to engage the bracket 10 with the object. The resilient members are friction enhancers which help to improve the frictional engagement of the flange 14 with the channel of the object. The resilient members 16 help to create a tight fit between the flange 14 and the channel of the object so that the object cannot easily or accidentally be removed from the bracket 10. The term "resilient" when used to describe the resilient members 16 refers to the ability of the resilient members 16 to fit within the channel of the object, and to recoil or recover their initial form or position once the flange 14 is removed from the channel of the object, or when the flange 14 is not present in the channel. The resiliency of the resilient members 16 may be derived from the following non-exhaustive list of factors: their material composition, their form or shape, and their configuration with respect to the flange 14.

The resilient members 16 extend away from one or both of the inner and outer surfaces 14B, 14C of the flange 14. This is the default position of each resilient member 16, which is assumed when the flange 14 is not inserted into the channel. Each resilient member 16 is resiliently displaceable toward the inner or outer surface 14B, 14C when the flange 14 is being inserted into the channel. The resilient displacement of the resilient members 16 allows them to fit into the channel along with the flange 14. Once the flange 14 is present within the channel, the recoil or resiliency of the resilient members 16 causes them to abut against the surface or surfaces that define the channel. This frictional abutment of the resilient members 16 with the surfaces of the channel helps to improve the frictional engagement of the flange 14 with the channel, and thus, to improve the frictional engagement of the bracket 10 with the object. It will be appreciated that the resilient members 16 may have different configurations to achieve such functionality, all of which are within the scope of the present disclosure.

Figure 5A:
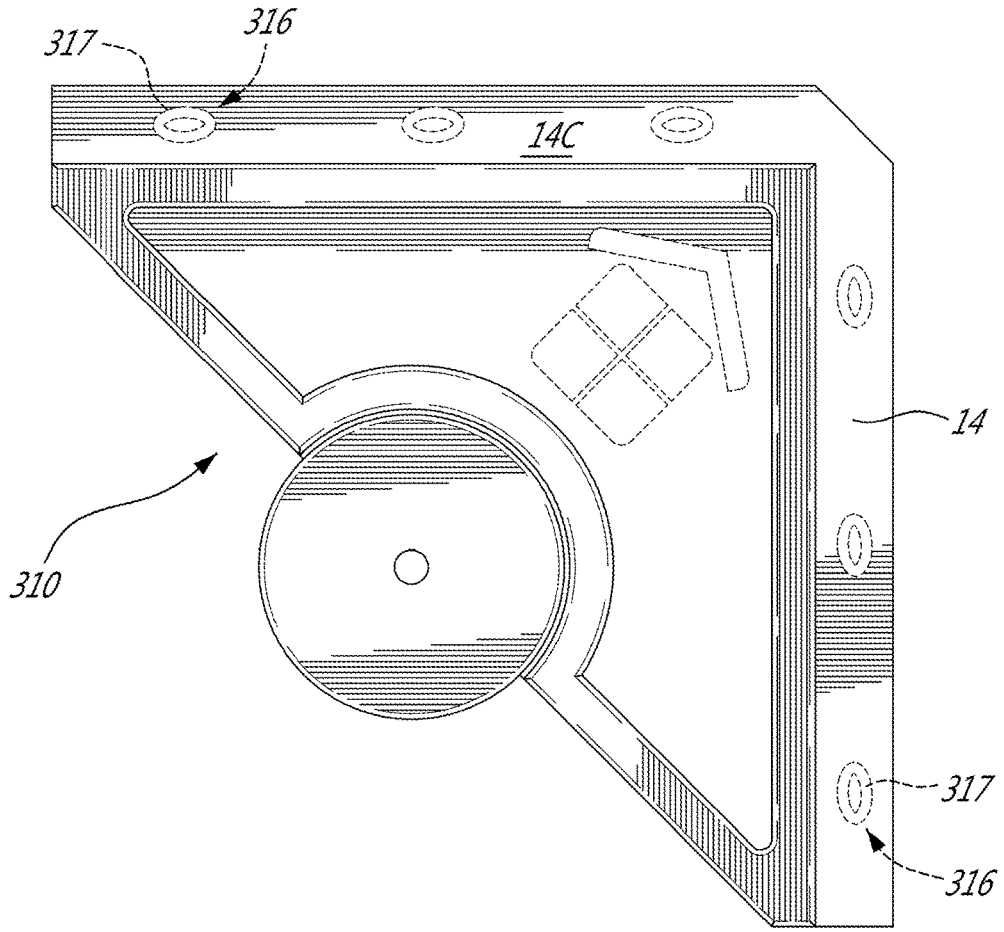
FIG. 5A is a perspective view of a bracket, according to yet another embodiment of the present disclosure.
Figure 5B:
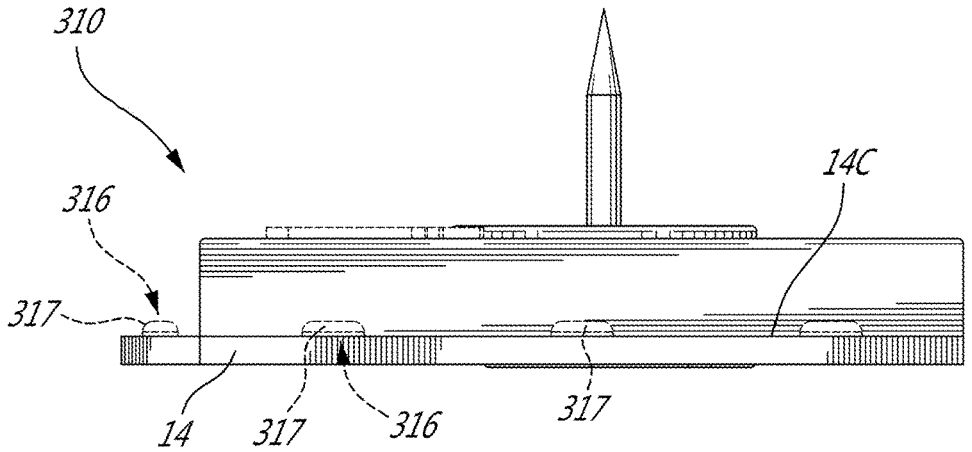
FIG. 5B is a side elevational view of the bracket of FIG. 5A.

One possible configuration of the resilient members 16 is shown in FIGS. 1A to 1D. Each resilient member 16 includes a tab 17 extending outwardly away from the outer surface 14C of the flange 14. The tabs 17 form an angle of extension a with the outer surface 14C (see FIG. 1D). The angle of extension a is acute, i.e. less than 90°, to facilitate the insertion of the flange 14 into the channel of the object. Each tab 17 is connected to the flange 14 along a hinge 17A about which the tab 17 pivots. Openings 18 in the flange 14 are formed between the inner and outer surfaces 14B, 14C. Each opening 18 is aligned with one of the tabs 17. Each opening 18 is sized and shaped to receive the tab 17 in the opening 18. Each tab 17 is resiliently displaceable relative to the opening 18. Therefore, when the flange 14 is being inserted into the channel of the object, the surfaces defining the channel abut against the tabs 17 and pivot them about their hinges 17A towards their corresponding openings 18. When the flange 14 is not present within the channel of the object, the resiliency of the tabs 17 causes them to extend outwardly away from the outer surface 14C, as shown in FIGS. 1A to 1D. Another possible configuration of the resilient members 316 is shown in FIGS. 5A and 5B, and described in greater detail below.

The tabs 17 can be formed using different techniques. One possible technique involves forming at least the flange 14 out of a metal, such as spring steel. The spring steel flange 14 is punched or stamped at different locations to form the tabs 17 and the openings 18. If desired, the remainder of the flange 14 can be overmolded with plastic, and the stamped tabs 17 can be left as exposed spring steel. In such an embodiment, the resiliency of the tabs 17 is derived from the inherent resiliency or springiness of the spring steel. Other techniques for forming the tabs 17 are possible and within the scope of the present disclosure. For example, another possible technique involves forming at least the flange 14 out of a plastic.

Still referring to FIGS. 1A to 1D, each of the tabs 17 is a geometric body formed from multiple walls. In the depicted embodiment, each tab 17 has an innermost wall 19A and an opposite outermost wall 19B, a top wall 19C and an opposite bottom wall 19D, and an end wall 19E extending between the top and bottom walls 19C, 19D. The innermost wall 19A is spaced closer to the wall surface 13A of the peripheral wall 13 than the other walls 19B, 19C, 19D, 19E. The outermost wall 19B is spaced furthest from the wall surface 13A of the peripheral wall 13 than the other walls 19A, 19C, 19D, 19E. The outermost wall 19B is inclined with respect to the outer surface 14C of the flange 14. More particularly, the outermost wall 19B extends from the outer surface 14C of the flange 14 at an angle referred to herein as the tab insertion angle β (see FIG. 1D). In the depicted embodiment, the tab insertion angle β is less than 90°. The acute angle of the outermost wall 19B allows the tab 17 to be inclined with respect the direction of insertion of the flange 19 into the channel of the object. The sloped outermost wall 19B of the tab 17 helps to insert the flange 14 and the tabs 17 into the channel of the object as each tab 17 is being resiliently displaced toward the outer surface 14C as the flange 14 is being inserted into the channel. Since the innermost wall 19A is not similarly sloped, the sloped outermost wall 19B of the tab 17 may also make it more difficult to remove the tab 17 once it is confined within the channel of the object and abutting against the surfaces thereof. The sloped outermost wall 19B may therefore help to reduce force required to insert the flange 14 into the channel, and may also help to increase the force required to pull the flange 14 out of the channel, thereby helping to secure the bracket 10 to the object.

In the depicted embodiment, an outermost edge 14E of the flange 14 is defined as the edge of the flange 14E being spaced furthest from the peripheral wall 13A. The outermost edge 14E is spaced further from the peripheral wall 13A than the outermost wall 19B of the tab 17 (see FIG. 1C). This allows the body of the flange 14 to be inserted into the channel of the object before the tabs 17, to help better position the flange 14 with respect to the channel prior to pushing the tabs 17 into the channel.

The arrangement and number of resilient members 16 along the flange 14 may vary. For example, in the embodiment of FIGS. 1A to 1D, all the resilient members 16 extend outwardly from the outer surface 14C of the flange 14 and are resiliently displaceable toward the outer surface 14C. In an alternate embodiment, all the resilient members 16 extend outwardly from the inner surface 14B of the flange 14 and are resiliently displaceable toward the inner surface 14B. In yet another alternate embodiment, some of the resilient members 16 extend outwardly from the inner surface 14B, and some of the resilient members 16 extend outwardly from the outer surface 14C of the flange 14. In the embodiment of FIGS. 1A to 1D, the resilient members 16 are spaced apart equally from each other along a length of the flange 14. More particularly, a spacing distance D is defined between adjacent resilient members 16 on the flange 14, and the spacing distance D is the same between all resilient members 16. In an alternate embodiment, the resilient members 16 are spaced apart irregularly. More particularly, the spacing distance D between two adjacent resilient members 16 is different than the spacing distance D between another two adjacent resilient members 16. The number of resilient members 16 can be more or less than the number of resilient members shown in the depicted embodiments. In an embodiment, the flange 14 has only one resilient member 16.

Figure 2A:
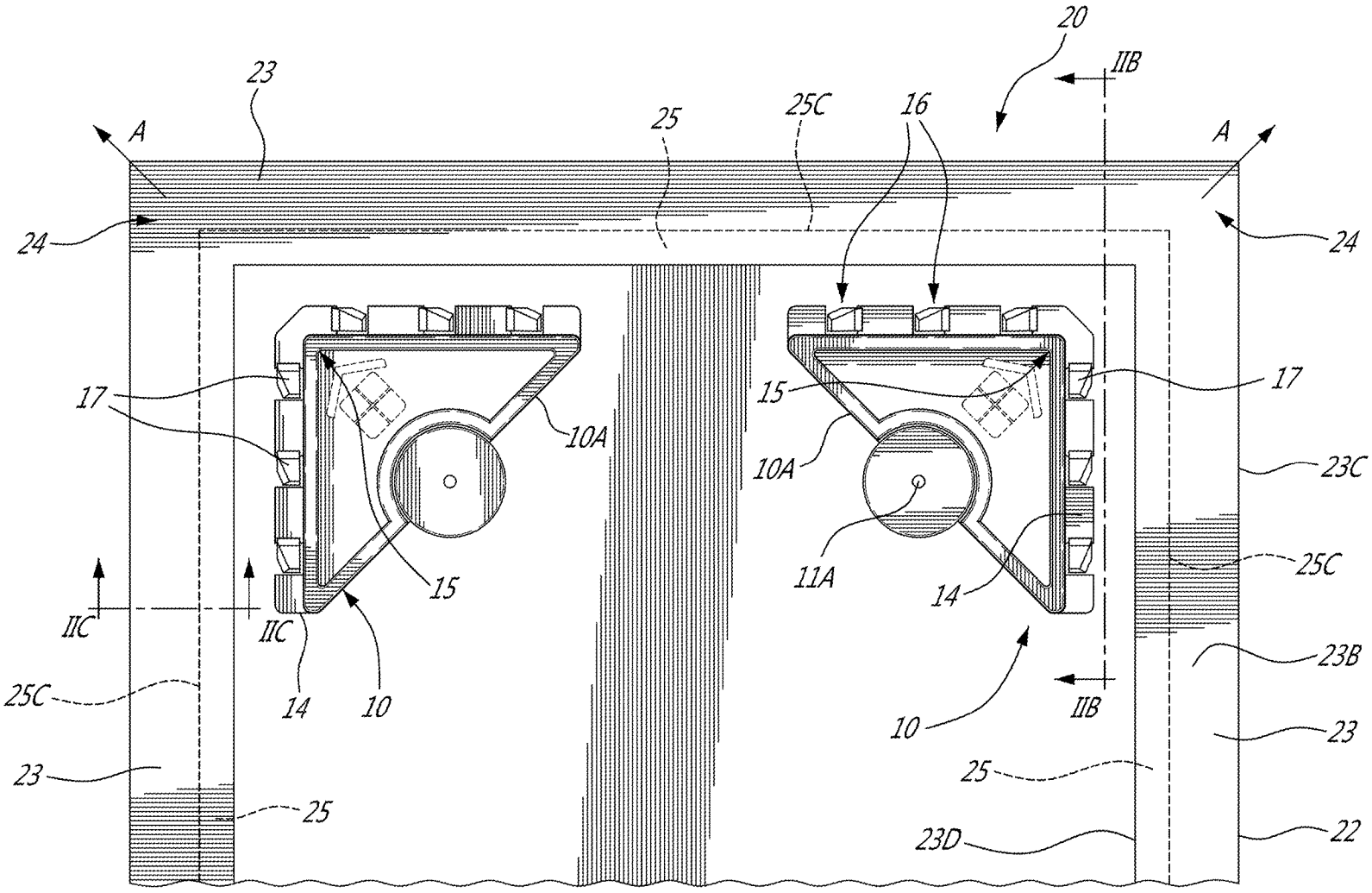
FIG. 2A is a rear plan view of a combination of a frame and two of the brackets of FIG. 1A.
Figure 2B:
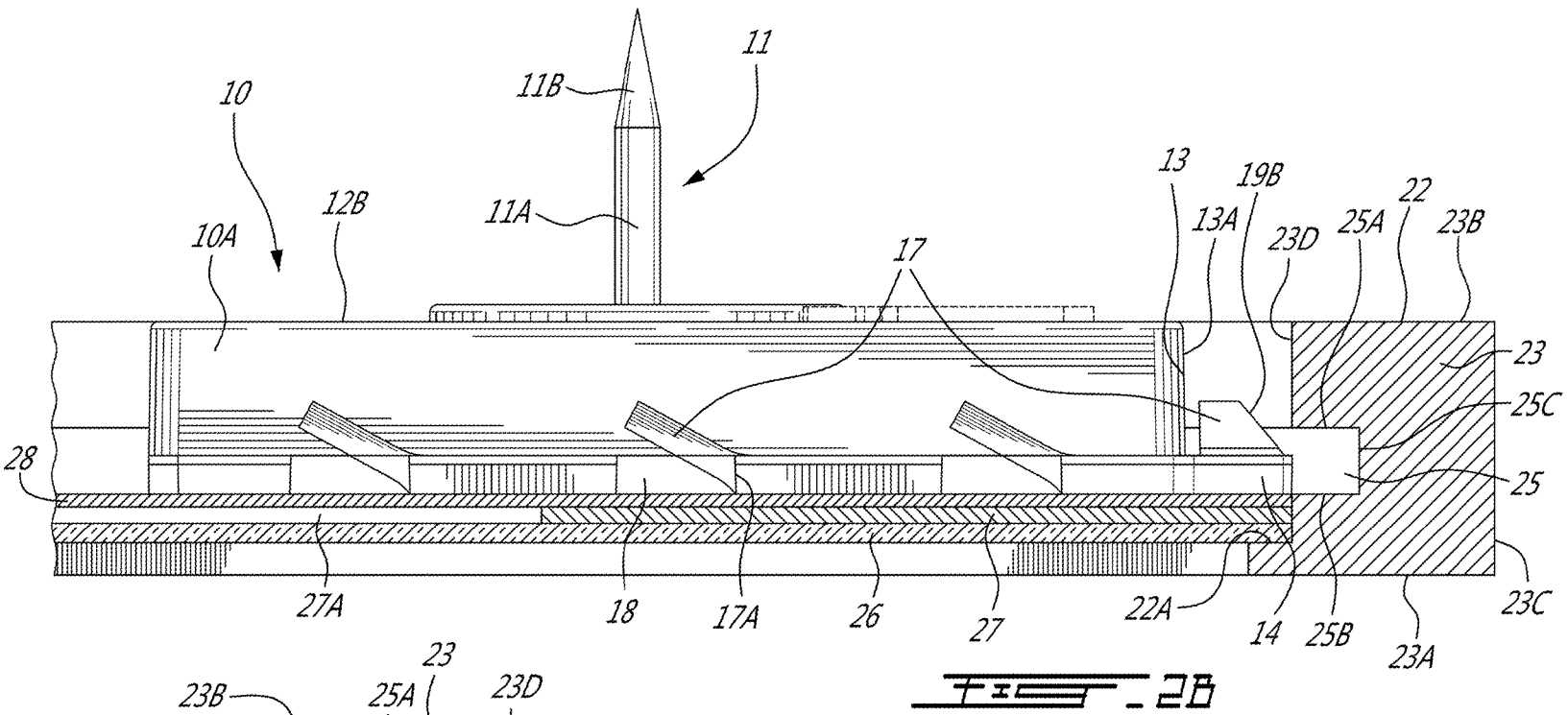
FIG. 2B is an enlarged cross-sectional view of the combination taken along the line IIB-IIB of FIG. 2A.
Figure 2C:
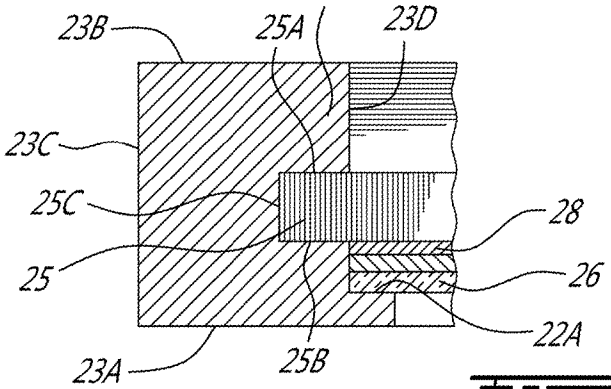
FIG. 2C is an enlarged cross-sectional view of the frame taken along the line IIC-IIC of FIG. 2A.

The function of the bracket 10 and the resilient members 16 will be better appreciated with reference to FIGS. 2A to 2C, which show one possible use and method of installing the bracket 10 for hanging the object 20 to a support structure (e.g. a wall). There are two brackets 10 shown in FIG. 2A. The object 20 in the depicted embodiment is a frame 22 for pictures and the like, and is shaped as a rectangular formed by four frame members 23. Each frame member 23 has a rectangular cross-sectional configuration having a front surface 23A, a rear surface 23B, and outer and inner side surfaces 23C, 23D. The frame members 23 form four inner right angle corners 24 at the junction of the top, bottom and side frame members 23. The channel 25 of the frame 22 extends into the frame members 23 from the inner surfaces 23D thereof. The channel 25 is defined by first and second opposed channel walls 25A, 25B, and a third channel wall 25C extending between the first and second channel walls 25A, 25B (see FIGS. 2B and 2C). The frame 22 can be made from any suitable material, including, but not limited to, wood, acrylonitrile butadiene styrene (ABS), polypropelene, and metal.

The frame 22 may be used for displaying artwork, pictures, and other display items. Referring to FIGS. 2B and 2C, the frame 22 has an outer pane of glass 26, and a rectangular mat 27 having a rectangular cut-out 27A formed therein for displaying a sheet of material 28 having indicia thereon such as a photograph, painting, or other type of visual work to be displayed and viewed through the glass 26. These various members generally have a rectangular shape complementary to and adapted to fit within the rectangular inner periphery of the frame 22 and supported on a ledge 22A of the frame 22. The frame 22 may also have an appropriate backing or backing plate.

Referring to FIGS. 2A and 2B, the brackets 10 are engaged to the frame 22 by sliding the corner 15 of the body 10A in the direction A in order to position the peripheral wall 13 and its wall surface 13A to face the inner surface 23D of the frame member 23. The flanges 14 are slid into the channels 25 formed in the inner surfaces 23D of the frame members 23. Pressure is applied to insert the flanges 14 into the channels 25. In the depicted embodiment, the wall surfaces 13A of the body 10A abut against and are mated with the inner surfaces 23D of the frame members 23 when the flanges 14 are inserted into the channels 25. As the flanges 14 are being slid into the channels 25, the first and second channel walls 25A, 25B of the channels 25 abut against the outermost walls 19B of the tabs 17 and cause the tabs 17 to resiliently displace about the hinges 17A toward the corresponding openings 18. Once the flanges 14 are inserted into the channels 25 of the frame 22, the first and/or second channel walls 25A, 25B confine the tabs 17 within the channel 25, and press them toward the openings 18. The resiliency of the tabs 17 causes them to abut against the first and/or second channel walls 25A, 25B, thereby helping to improve the frictional engagement of the flanges 14 with the channels 25, and of the bracket 10 with the frame 22.

It will be appreciated that by being resiliently displaceable from a default extended configuration to a compressed configuration, each tab 17 helps the flange 14 to friction fit within channels 25 of different sizes, and thus helps the bracket 10 to compensate for variations in the size of channel 25. It is known that frames 22 which are mass manufactured can have important variations in the size of their channels 25. The resiliently displaceable resilient members 16 disclosed herein therefore help the bracket 10 to function with channels 25 of different sizes, and thus, help the bracket 10 to function with a greater number of frames 22.

With two brackets 10 attached to the frame 22, the frame 22 can be mounted to the support structure. The attachment pins 11A of each bracket 10 face outwardly from the outer surface 12B of the body 10A. The frame 22 is placed adjacent to a wall or other support structure such that the sharp, pointed end 11B of the attachment pin 11A is facing the support structure. The frame 22 is pressed firmly against the support structure to press the pointed ends 11B of the attachment pins 11A into the support structure. The attachment pins 11A will support the frame 22 on and substantially flush against the surface of support structure with no additional hardware being required or visible.

Figure 3:
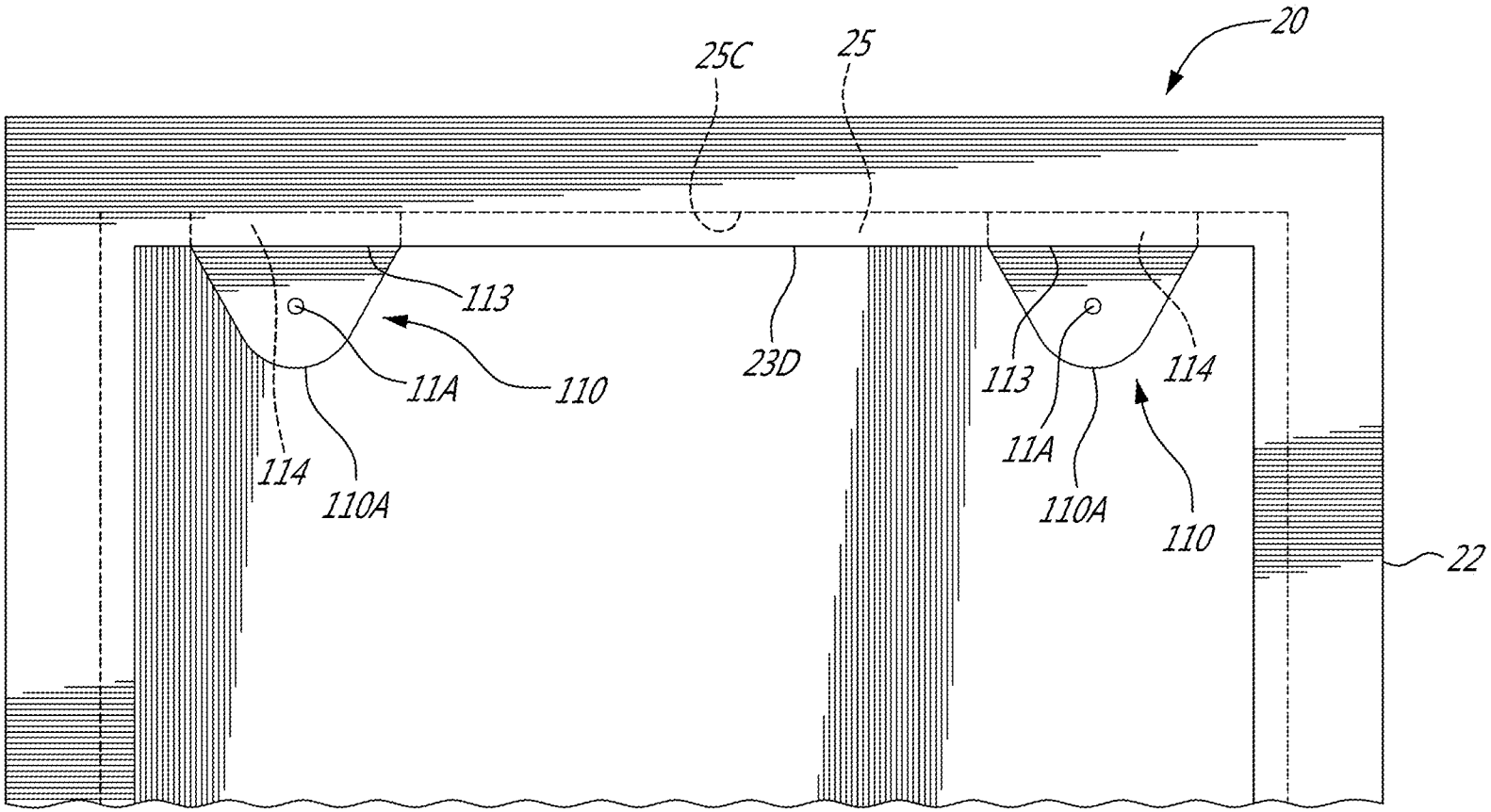
FIG. 3 is a rear plan view of a combination of a frame and two brackets, according to another embodiment of the present disclosure.

Another embodiment of the bracket 110 is shown in FIG. 3. The bracket 110 has a single peripheral wall 113 and a single flange 114 extending outwardly therefrom. Two brackets 110 are shown for use with the object 20, which in the depicted embodiment is a frame 22. The flanges 114 of the brackets 110 are inserted into the channel 25 along the inner surface 23D of only the upper frame member 23. The brackets 110 of the depicted embodiment are therefore not placed into the corners of the frame 22. The body 110A of each bracket 110 has a pyramidal shape with a rounded apex.

Figure 4A:
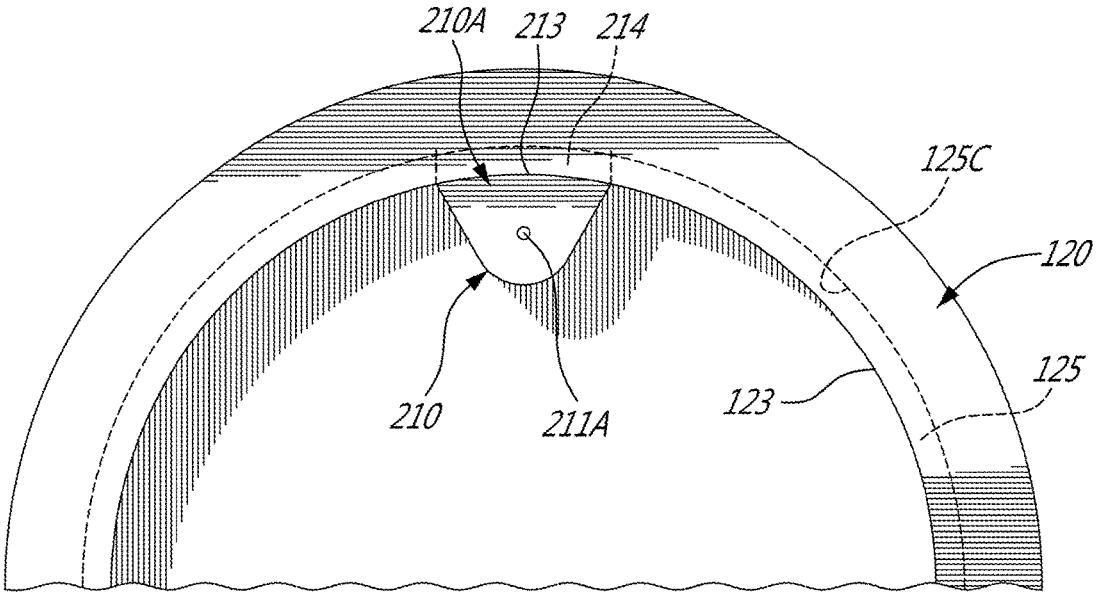
FIG. 4A is a rear plan view of a combination of a frame and a bracket, according to yet another embodiment of the present disclosure.
Figure 4B:
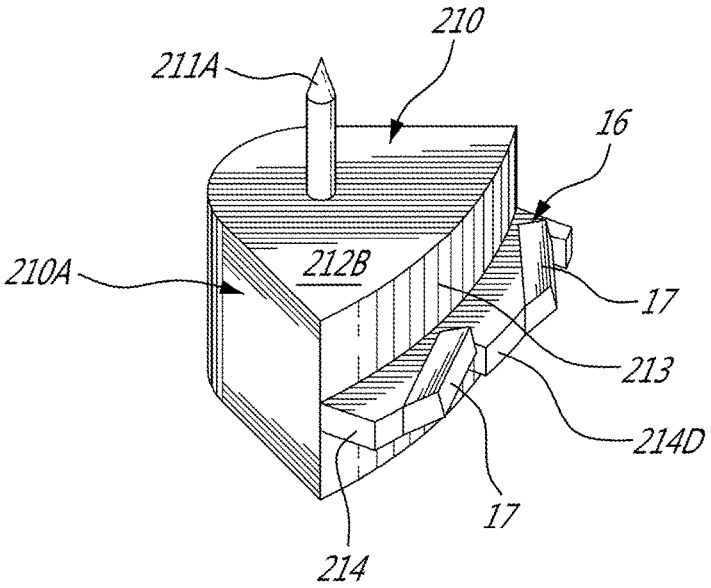
FIG. 4B is a perspective view of the bracket of FIG. 4A.

Yet another embodiment of the bracket 210 is shown in FIGS. 4A and 4B. The bracket 210 has a single peripheral wall 213 and a single flange 214 extending outwardly therefrom. The peripheral wall 213 and the flange 214 are both curved to match the curvature of the channel 125 along the inner surface 123D of the object 120. In the depicted embodiment, the object 120 is a rounded object, such a mirror. The bracket 210 is used alone to support the object 120 and to mount it to the support structure. The body 210A of the bracket 210 has a pyramidal shape with a rounded apex. The intermediate surface 214D of the flange 214 is curved to mate with the curved third channel wall 125C of the channel 125 when the flange 214 is inserted into the channel 125. In the depicted embodiment, the attachment pin 211A is integral with the body 210A, and projects outwardly from the outer surface 212B of the body 210A. In an alternate embodiment, the attachment pin 11A, 211A is separate from the body 10A, 210A, and attachable and detachable therefrom.

Yet another embodiment of the bracket 310 is shown in FIGS. 5A and 5B. FIGS. 5A and 5B show another configuration of the resilient members 316. The bracket 310 is similar to the bracket 10 described above, and therefore like features of bracket 310 will bear like reference numbers. Each resilient member 316 in the depicted embodiment includes a resilient protrusion 317 projecting outwardly away from the outer surface 14C of the flange 14. Each resilient protrusion 317 is resiliently deformable toward the outer surface 14C. Therefore, when the flange 14 is being inserted into the channel 25 of the object 20, the first and/or second channel walls 25A, 25B defining the channel 25 abut against each resilient protrusion 317 and compress it toward the outer surface 14C. The springiness or resiliency of the resilient protrusions 317 causes them to abut against the first and/or second channel walls 25A, 25B of the channel. This frictional abutment of the resilient protrusions 317 with the walls 25A, 25B of the channel 25 helps to improve the frictional engagement of the flange 14 with the channel 25, and thus, to improve the frictional engagement of the bracket 310 with the object 20. When the flange 14 is not present within the channel 25 of the object 20, the resiliency of the resilient protrusions 317 causes them to extend outwardly away from the outer surface 14C. The resilient protrusions 317 may be made of any suitable material, such as an elastomeric material or a polymer material.

It will be appreciated that other configurations of the resilient members 16,316 are within the scope of the present disclosure. For example, in yet another alternate embodiment, the resilient members 16, 316 include one or more elongated and elastomeric strips extending outwardly from the inner and/or outer surfaces 14B, 14C of the flange 14 along a length thereof.

It can be appreciated that the bracket 10, 110, 210, 310 disclosed herein helps to securely attach various types of objects 20 such as framed members, mirrors, clocks, wall art, etc. in a substantially flush manner to a support structure with less hardware. The bracket 10, 110, 210, 310 can utilize the internal channel present on many frames 22 to eliminate the necessity of attaching the bracket 10, 110, 210, 310 to the frame 22 with additional fasteners.

The above description is meant to be exemplary only, and one skilled in the art will recognize that changes may be made to the embodiments described without departing from the scope of the invention disclosed. Still other modifications which fall within the scope of the present invention will be apparent to those skilled in the art, in light of a review of this disclosure, and such modifications are intended to fall within the appended claims.

The invention claimed is:

1. A bracket engageable with an object to position the object relative to a support structure, the object having a mating surface and a channel extending into the mating surface, the bracket comprising:

a body having at least one peripheral wall defining a wall surface, the wall surface facing the mating surface upon the bracket engaging the object, the body having a flange extending outwardly from the wall surface of the at least one peripheral wall and having an outer surface and an opposed inner surface, the flange being insertable into the channel of the object to engage the bracket with the object, the flange having at least one resilient member including a tab extending away from said surface of the flange at an angle thereto, the at least one resilient member being resiliently displaceable toward said surface of the flange upon the flange being inserted into the channel to abut the at least one resilient member against a surface of the channel, an opening in the flange between the inner and outer surfaces, the opening being sized and shaped to receive the tab therein, the tab being resiliently displaceable relative to the opening; and a position element extending outwardly from the body.

2. The bracket as defined in claim 1, wherein the tab includes at least two walls including an outermost wall, the outermost wall being spaced farther from the peripheral wall of the body than the other walls of the tab, the outermost wall extending from said surface of the flange at a tab insertion angle.

3. The bracket as defined in claim 2, wherein the tab insertion angle is less than 90°.

4. The bracket as defined in claim 2, wherein the flange has an outermost edge, the outermost edge being spaced farther from the peripheral wall of the body than the outermost wall of the tab.

5. A bracket engageable with an object to position the object relative to a support structure, the object having a mating surface and a channel extending into the mating surface, the bracket comprising:

a body having at least one peripheral wall defining a wall surface, the wall surface facing the mating surface upon the bracket engaging the object, the body having a flange extending outwardly from the wall surface of the at least one peripheral wall and having an outer surface and an opposed inner surface, the flange being insertable into the channel of the object to engage the bracket with the object, the flange having at least a first resilient member and a second resilient member, the first resilient member extending away from the outer surface of the flange and being resiliently displaceable toward the outer surface, the second resilient member extending away from the inner surface of the flange and being resiliently displaceable toward the inner surface, the at least first and second resilient members being resiliently displaceable toward said corresponding inner and outer surface of the flange upon the flange being inserted into the channel to abut the at least first and second resilient members against a surface of the channel; and a position element extending outwardly from the body.

6. A bracket engageable with an object to position the object relative to a support structure, the object having a mating surface and a channel extending into the mating surface, the bracket comprising:

a body having at least one peripheral wall defining a wall surface, the wall surface facing the mating surface upon the bracket engaging the object, the body having a flange extending outwardly from the wall surface of the at least one peripheral wall and having an outer surface and an opposed inner surface, the flange being insertable into the channel of the object to engage the bracket with the object, the flange having resilient members spaced apart along a length of the flange and extending away from at least one of the inner and outer surfaces of the flange, a spacing distance being defined between adjacent resilient members on the flange, the spacing distance being the same between all resilient members, the resilient members being resiliently displaceable toward said surface of the flange upon the flange being inserted into the channel to abut the resilient members against a surface of the channel; and a position element extending outwardly from the body.

7. A bracket engageable with an object to position the object relative to a support structure, the object having a mating surface and a channel extending into the mating surface, the bracket comprising a body having at least one peripheral wall defining a wall surface, the wall surface facing the mating surface upon the bracket engaging the object, the body having a flange extending outwardly from the wall surface of the at least one peripheral wall and having an outer surface and an opposed inner surface, the flange being insertable into the channel of the object to engage the bracket with the object, the flange having resilient members spaced apart along a length of the flange and extending away from at least one of the inner and outer surfaces of the flange, a spacing distance being defined between adjacent resilient members on the flange, the spacing distance between two adjacent resilient members being different than the spacing distance between another two adjacent resilient members, the resilient members being resiliently displaceable toward said surface of the flange upon the flange being inserted into the channel to abut the resilient members against a surface of the channel; and a position element extending outwardly from the body.

8. A bracket engageable with an object to position the object relative to a support structure, the object having a mating surface and a channel extending into the mating surface, the bracket comprising:

a body having at least one peripheral wall defining a wall surface, the wall surface facing the mating surface upon the bracket engaging the object, the body having a flange extending outwardly from the wall surface of the at least one peripheral wall and having an outer surface and an opposed inner surface, the flange being insertable into the channel of the object to engage the bracket with the object, the flange having at least one resilient member extending away from at least one of the inner and outer surfaces of the flange, the at least one resilient member being resiliently displaceable toward said surface of the flange upon the flange being inserted into the channel to abut the at least one resilient member against a surface of the channel; and a position element including an attachment pin mounted to the body and extending outwardly therefrom, the attachment pin terminating in a sharp pointed end, the bracket being configured for mounting the object to the support structure.

9. A bracket engageable with an object to position the object relative to a support structure, the object having a mating surface and a channel extending into the mating surface, the bracket comprising:

a body having at least one peripheral wall defining a wall surface, the wall surface facing the mating surface upon the bracket engaging the object, the body having a flange extending outwardly from the wall surface of the at least one peripheral wall and having an outer surface and an opposed inner surface, the flange being insertable into the channel of the object to engage the bracket with the object, the flange having at least one resilient member extending away from at least one of the inner and outer surfaces of the flange, the at least one resilient member being resiliently displaceable toward said surface of the flange upon the flange being inserted into the channel to abut the at least one resilient member against a surface of the channel; and a position element having a marking device mounted to the body and extending outwardly therefrom, the marking device terminating in a marking element, the bracket being configured for marking the support structure.

10. A combination of a frame and a bracket to position the frame relative to a support structure:

the frame having an inner surface with a channel extending into the inner surface; and the bracket comprising:

a body having at least one peripheral wall defining a wall surface, the wall surface facing the inner surface upon the bracket engaging the frame, the body having a flange extending outwardly from the wall surface of the at least one peripheral wall and having an outer surface and an opposed inner surface, the flange being insertable into the channel of the frame to engage the bracket with the frame, the flange having a tab extending away from at least one of the inner and outer surfaces of the flange at an angle thereto, the tab being resiliently displaceable toward said surface of the flange upon the flange being inserted into the channel to abut the tab against a surface of the channel, and an opening in the flange between the inner and outer surfaces, the opening being sized and shaped to receive the tab therein, the tab being resiliently displaceable relative to the opening; and a position element extending outwardly from the body.

11. The combination as defined in claim 10, wherein the at least one peripheral wall of the body extends between an outer surface of the body and an inner surface of the body, the flange extending outwardly from the wall surface at the inner surface of the body.

12. The combination as defined in claim 10, wherein the tab includes at least two walls including an outermost wall, the outermost wall being spaced farther from the peripheral wall of the body than the other walls of the tab, the outermost wall extending from said surface of the flange at a tab insertion angle.

13. The combination as defined in claim 12, wherein the tab insertion angle is less than 90°.

14. The combination as defined in claim 12, wherein the flange has an outermost edge, the outermost edge being spaced farther from the peripheral wall of the body than the outermost wall of the tab.

15. A combination of a frame and a bracket to position the frame relative to a support structure:

the frame having an inner surface with a channel extending into the inner surface; and the bracket comprising:

a body having at least one peripheral wall defining a wall surface, the wall surface facing the inner surface upon the bracket engaging the frame, the body having a flange extending outwardly from the wall surface of the at least one peripheral wall and having an outer surface and an opposed inner surface, the flange being insertable into the channel of the frame to engage the bracket with the frame, the flange having resilient members spaced apart along a length of the flange, a spacing distance being defined between adjacent resilient members on the flange, the spacing distance being the same between all resilient members, the resilient members extending away from at least one of the inner and outer surfaces of the flange, the resilient members being resiliently displaceable toward said surface of the flange upon the flange being inserted into the channel to abut the resilient members against a surface of the channel; and a position element extending outwardly from the body.

* * * * *